US007143669B2

(12) United States Patent
Hu

(10) Patent No.: US 7,143,669 B2
(45) Date of Patent: Dec. 5, 2006

(54) WRENCH COMBINATION

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 129 days.

(21) Appl. No.: 10/978,591

(22) Filed: Nov. 1, 2004

(65) Prior Publication Data

US 2005/0097995 A1 May 12, 2005

(30) Foreign Application Priority Data

Nov. 7, 2003 (TW) ..... 92131165 A

(51) Int. Cl.
*B25B 13/46* (2006.01)
*B25B 13/06* (2006.01)

(52) U.S. Cl. ..... 81/60; 81/177.85; 81/438

(58) Field of Classification Search ..... 81/177.85, 81/60–63.2, 438
See application file for complete search history.

(56) References Cited

U.S. PATENT DOCUMENTS 3,490,317 A * 1/1970 Rozmus ..... 81/62
4,602,534 A * 7/1986 Moetteli ..... 81/177.85
5,901,620 A * 5/1999 Arnold ..... 81/63.2
2003/0150299 A1* 8/2003 Chen ..... 81/63.2
2004/0025643 A1* 2/2004 Hsien ..... 81/60

FOREIGN PATENT DOCUMENTS

TW 366849 8/1999

* cited by examiner

*Primary Examiner*—Debra S Meislin
(74) *Attorney, Agent, or Firm*—Alan D. Kamrath; Nikolai & Mersereau, P.A.

(57) ABSTRACT

A wrench combination includes a wrench and a drive member. An inner protrusion is formed on a polygonal inner periphery of a box end of the wrench. The drive member includes an engaging portion removably mounted in the box end and engaged with the polygonal inner periphery, with an end of the drive member being located outside the box end. The engaging portion includes a retaining section. A retaining member is mounted on the drive member. Each of the retaining section and the retaining member has an outer diameter greater than a diameter of a hole delimited by the inner protrusion. The retaining section and the retaining member respectively abut against two end faces of the inner protrusion to position the drive member. The retaining member is compressible to be smaller than the diameter of the hole delimited by the inner protrusion.

15 Claims, 13 Drawing Sheets

WRENCH COMBINATION

BACKGROUND OF THE INVENTION

1. Field of the Invention

The present invention relates to a wrench combination. In particular, the present invention relates to a wrench combination comprising a wrench and a drive member that can be removably mounted into a box end of the wrench.

2. Description of the Related Art

FIG. 1 of the drawings illustrates a conventional wrench combination comprising a wrench and a drive member 2 for driving sockets. The wrench includes a box end including a polygonal inner periphery 1 in which the drive member 2 is mounted. A ball 3 in the drive member 2 is biased by a spring (not shown) to press against the polygonal inner periphery 1 of the box end of the wrench, thereby retaining the drive member 2 in the box end of the wrench.

FIG. 2 illustrates another conventional wrench combination comprising a wrench and a drive member 4 for driving sockets. The drive member 4 includes an annular groove (not labeled) in an outer periphery of an end thereof. An O-ring or C-clip 5 is mounted in the annular groove of the drive member 4. The C-clip 5 is in a compressed state and thus exerts an outward resilient returning force to press against the polygonal inner periphery 1 of the wrench, thereby retaining the drive member 4 in the box end of the wrench.

FIG. 3 illustrates a further conventional wrench combination comprising a wrench and a drive member 6 for driving sockets. An annular groove 70 is defined in a polygonal inner periphery 1 of a box end of the wrench. A C-clip 7 is partially received in the annular groove 70. The C-clip 7 is in an expanded state when the drive member 6 is mounted into the box end of the wrench. An inward resilient returning force causes the C-clip 7 to press against an outer periphery of an end of the drive member 6, thereby retaining the drive member 6 in the box end of the wrench.

However, the above three drive members 2, 4, 6 could not provide a force sufficient to reliably retain the drive members 2, 4, 6 in the box end of the wrench. As illustrated in FIG. 4, when a socket 60 coupled with the other end of the drive member 6 is to be removed, the drive member 6 is pulled outward along with the socket 60 and easily disengages from the box end of the wrench easily, as the C-clip 7 (or the ball 3 in FIG. 1) is in a compressed or expanded state and thus merely provides a retaining force in a direction perpendicular to the pulling direction and as the C-clip 7 (or the ball 3 in FIG. 1) is in sliding contact with the polygonal inner periphery 1 of the box end of the wrench. As a result, the user has to disengage the socket 60 from the drive member 6 and then reinsert the drive member 6 into the box end of the drive member, which is time-consuming, troublesome, and laborsome.

FIG. 5 illustrates still another conventional wrench combination comprising a wrench and a drive member 8. An end of the drive member 8 is mounted in a box end of the wrench. A resilient member 9 is mounted to an end face of the drive member 8 and exerts a relatively large force to a polygonal inner periphery 1 of the box end of the wrench, securely retaining the drive member 8 in the box end of the wrench. However, such a resilient member 9 has a high manufacturing cost and is thus less competitive on the market.

FIG. 6 shows yet another conventional wrench combination comprising a wrench 1' and a drive member 2'. FIG. 7 is a top view of the wrench 1' and the drive member 2' in FIG. 6. The wrench 1' includes a handle 11' and a box end 12' on an end of the handle 11'. The box end 12' includes a polygonal inner periphery 121'. The polygonal inner periphery 121' is processed to form an annular groove 120' that is deeper than the deepest portion of the polygonal inner periphery 121'. A C-clip 3' is mounted in the annular groove 120' in a compressed state to exert a force to securely hold an end 21' of the drive member 2' by a plurality of protrusions 31' on an inner periphery of the C-clip 3'. However, the annular groove 120' is too deep and thus weakens the structure of the box end 12', as the wall thickness of the box end 12' becomes relatively small due to provision of the annular groove 120'. The torque capacity of the wrench is significantly reduced.

SUMMARY OF THE INVENTION

In accordance with an aspect of the present invention, a wrench combination comprises a wrench and a drive member removably mounted in a box end of the wrench. An inner protrusion is formed on a polygonal inner periphery of the box end of the wrench.

The drive member includes an engaging portion removably mounted in the box end of the wrench and engaged with the polygonal inner periphery, with an end of the drive member being located outside the box end of the wrench. The engaging portion includes a retaining section having an outer diameter greater than a diameter of a hole delimited by the inner protrusion. The retaining section abuts against an end face of the inner protrusion when the engaging portion is mounted in the box end of the wrench.

A retaining member is mounted on the drive member and includes an outer diameter greater than the diameter of the hole delimited by the inner protrusion. The retaining member abuts against the other end face of the inner protrusion when the engaging portion is mounted in the box end of the wrench. The retaining member is compressible to be smaller than the diameter of the hole delimited by the inner protrusion.

The retaining member abuts against the other end face of the inner protrusion when the retaining member is in a natural state.

In an embodiment of the invention, the retaining section is a shoulder and the retaining member is a C-clip. The inner protrusion is formed on an end of the polygonal inner periphery. The other end of the drive member includes an annular groove for receiving the retaining member.

In another embodiment, the drive member includes an annular groove defined between the engaging portion and the end of the drive member. The retaining member is received in the annular groove.

In a further embodiment, the polygonal inner periphery includes an annular groove. An insert is received in the annular groove and protrudes into a hole delimited by the polygonal inner periphery to form the inner protrusion.

In still another embodiment, the drive member including a gear rotatably mounted in the box end, with the gear defining the polygonal inner periphery. A switching member may be provided for controlling a ratcheting direction and a free rotating direction of the gear.

The end of the drive member may be a socket-engaging member or a screwdriver bit.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
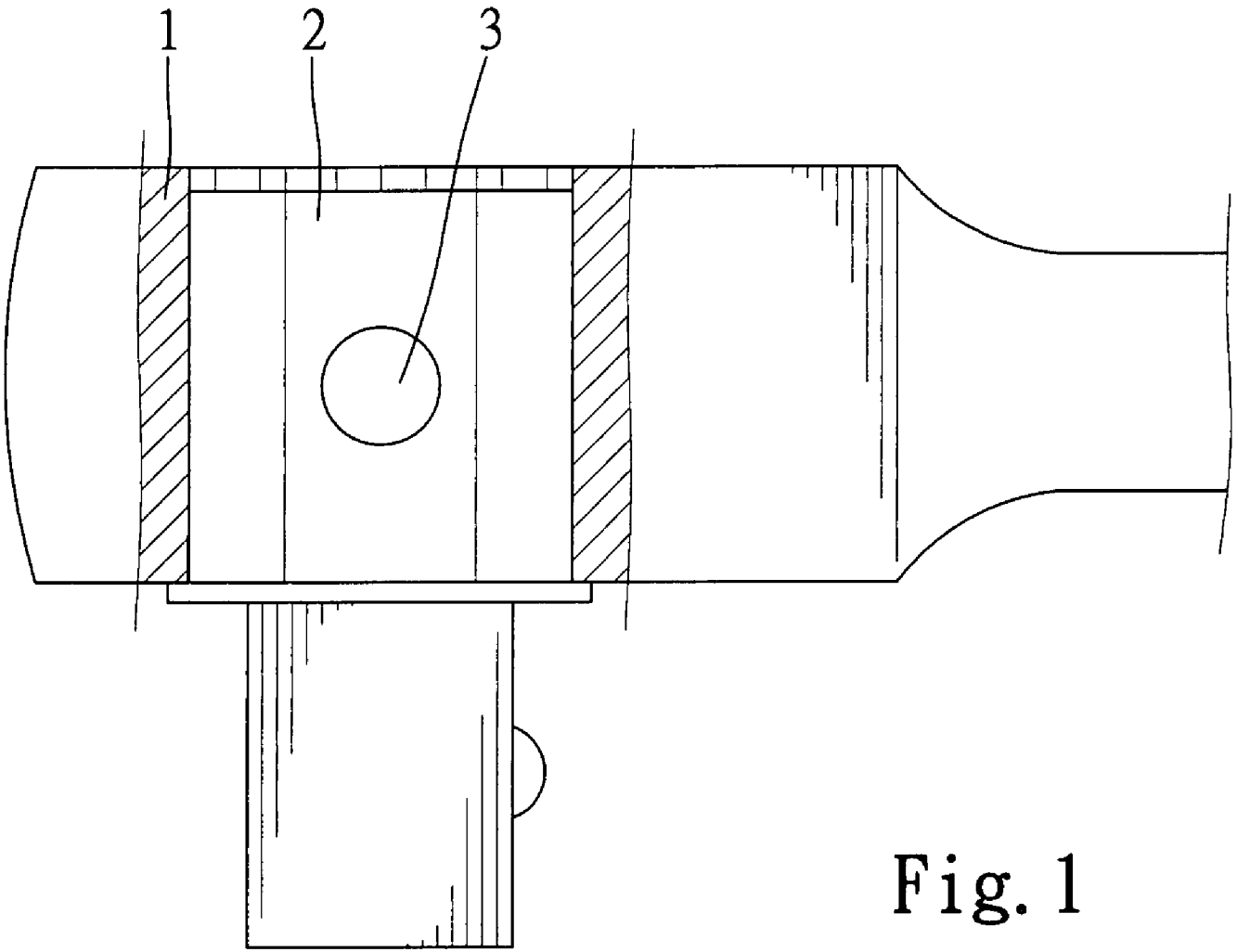
Fig. 1 PRIOR ART
FIG. 1 is a partly sectioned side view of a conventional wrench combination.
Figure 2:
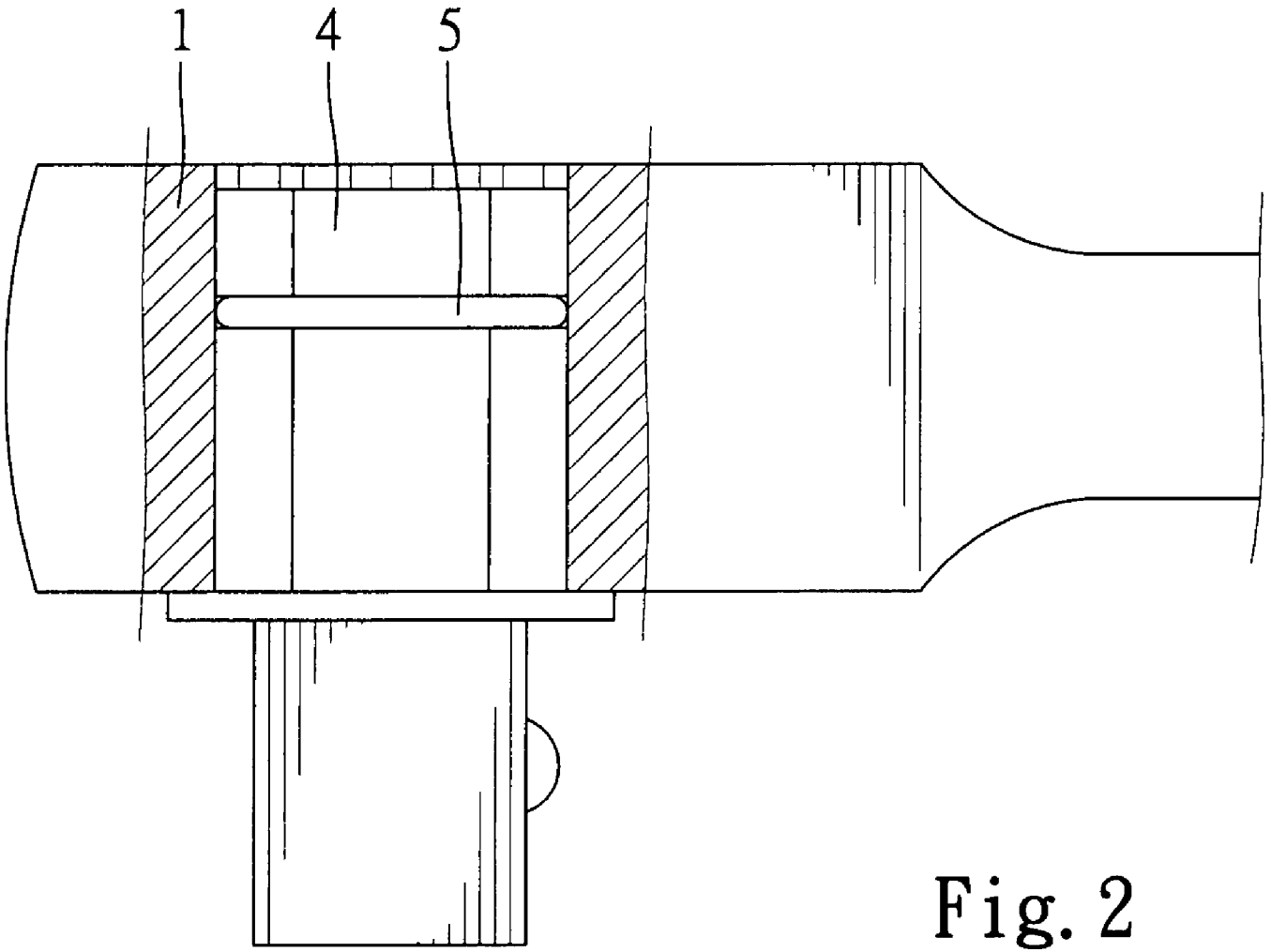
Fig. 2 PRIOR ART
FIG. 2 is a partly sectioned side view of another conventional wrench combination.
Figure 3:
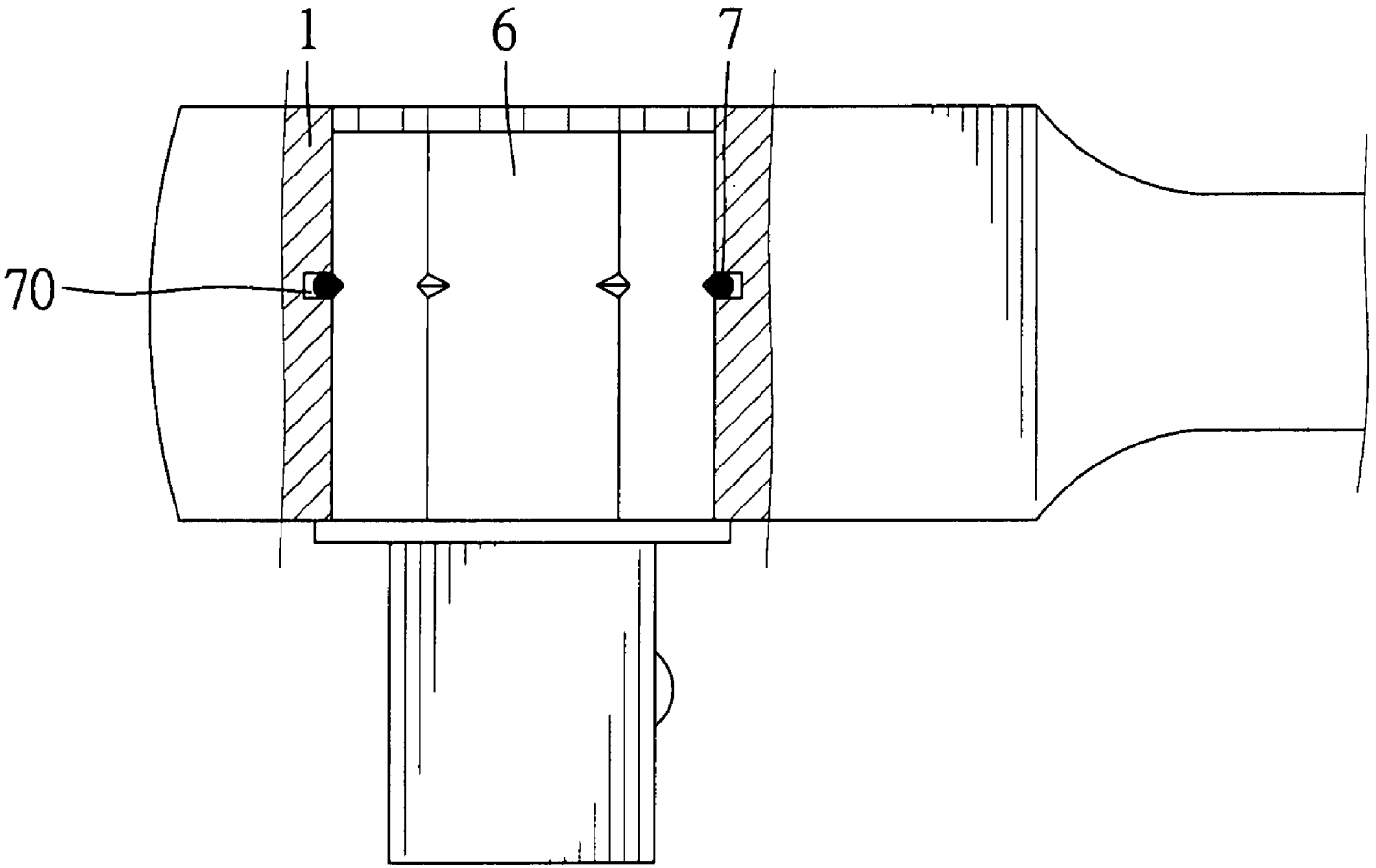
Fig. 3 PRIOR ART
FIG. 3 is a partly sectioned side view of a further conventional wrench combination.
Figure 4:
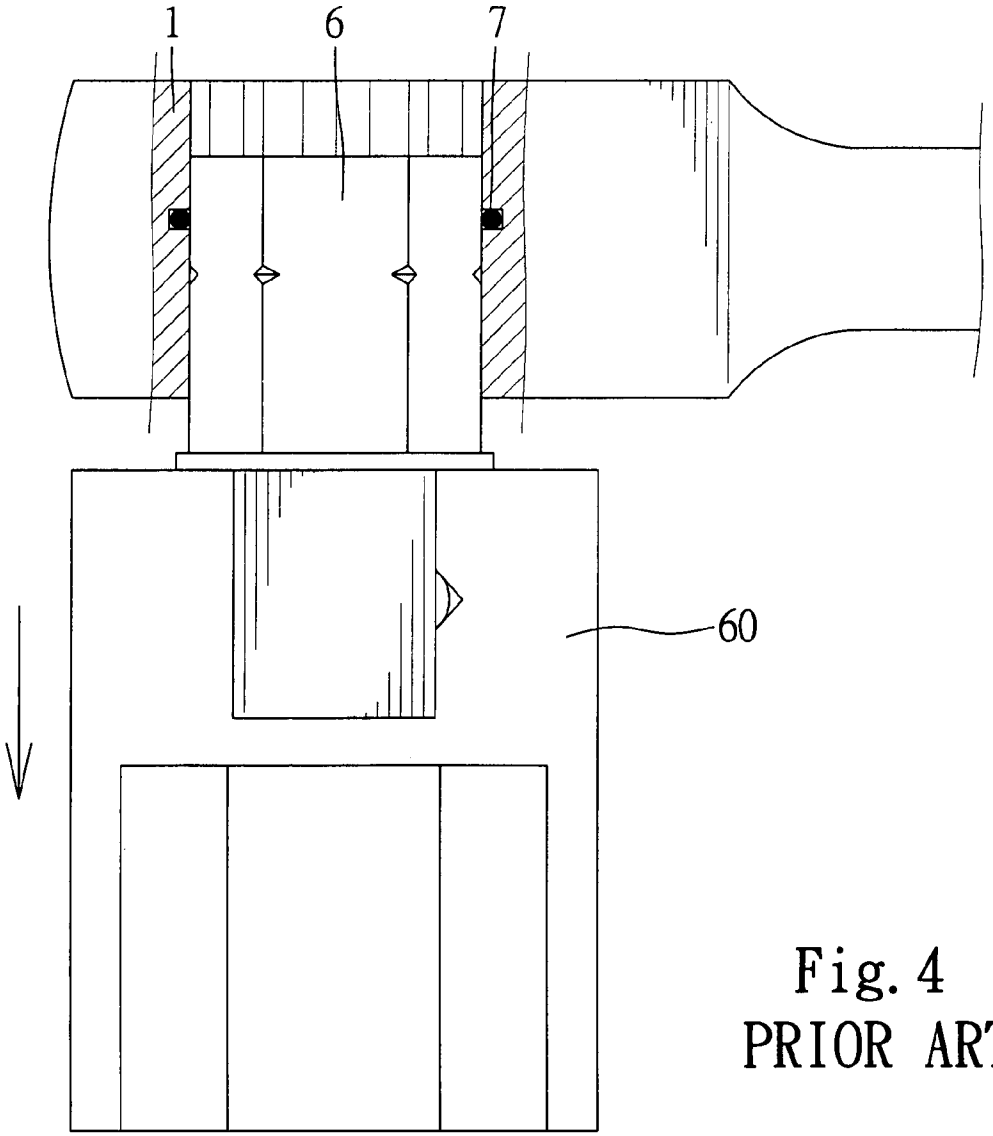
Fig. 4 PRIOR ART
FIG. 4 is a partly sectioned side view illustrating disengagement of the drive member from a wrench in FIG. 3.
Figure 5:
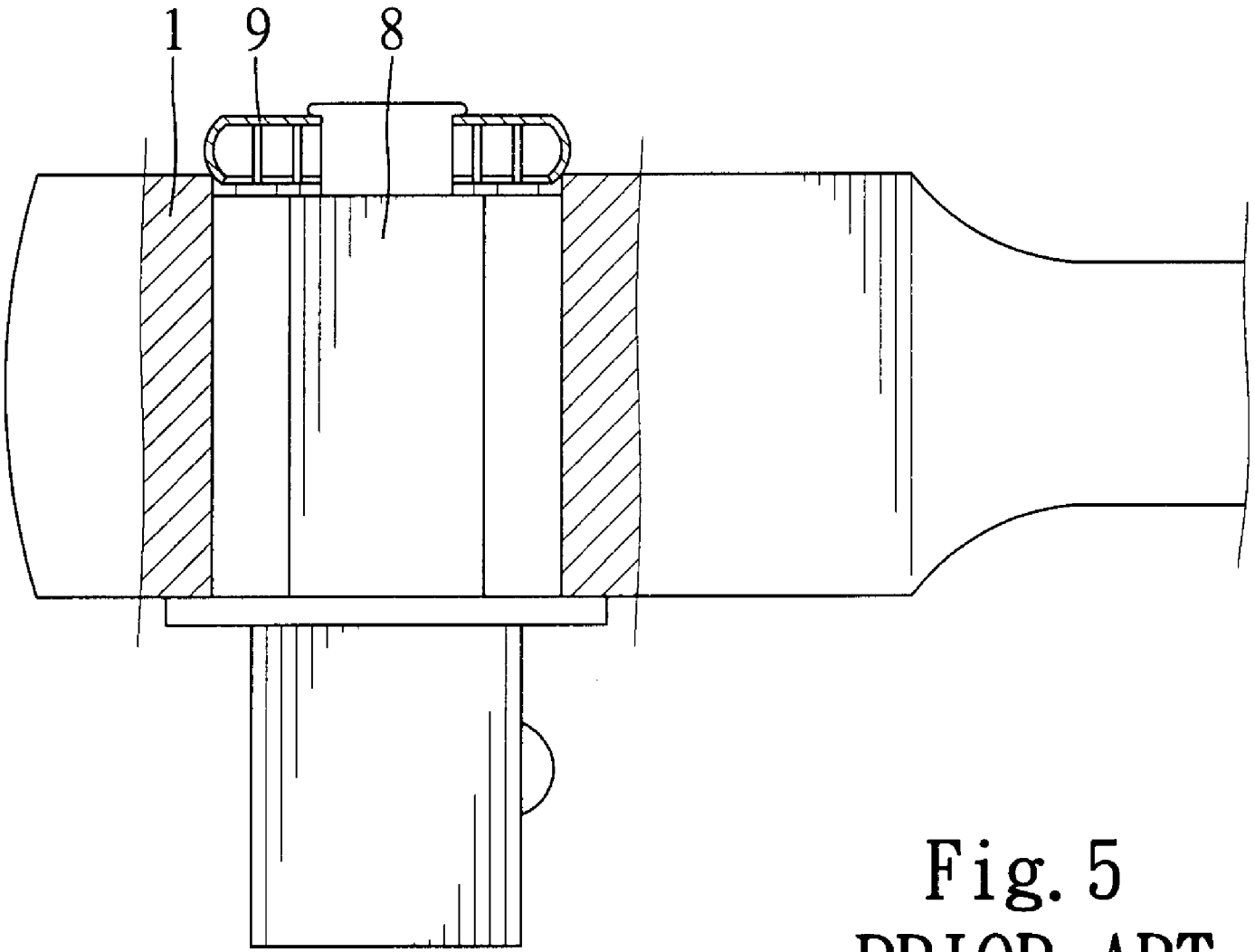
Fig. 5 PRIOR ART
FIG. 5 is a partly sectioned side view of still another conventional wrench combination.
Figure 6:
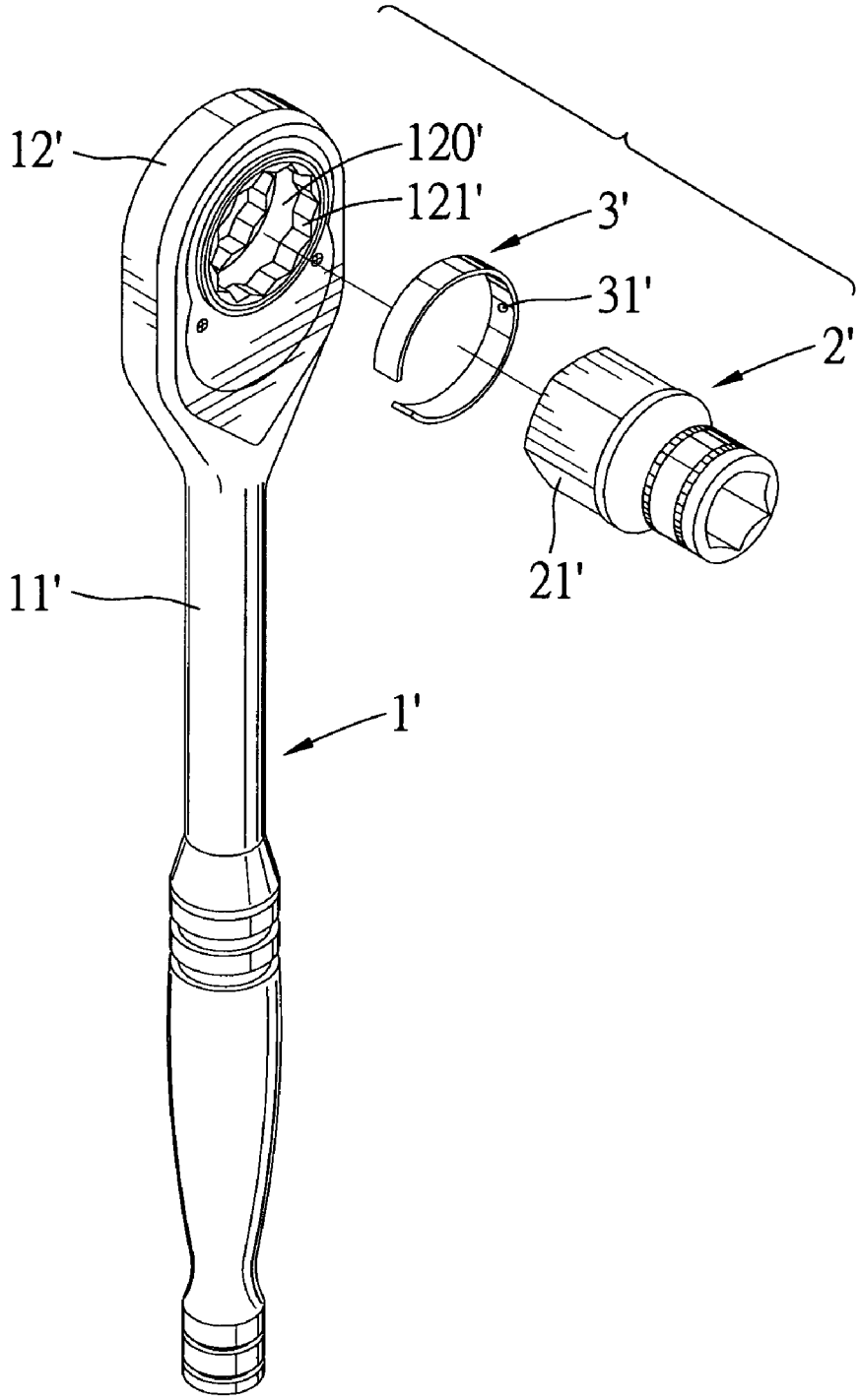
Fig. 6 PRIOR ART
FIG. 6 is an exploded perspective view of yet another conventional wrench combination.
Figure 7:
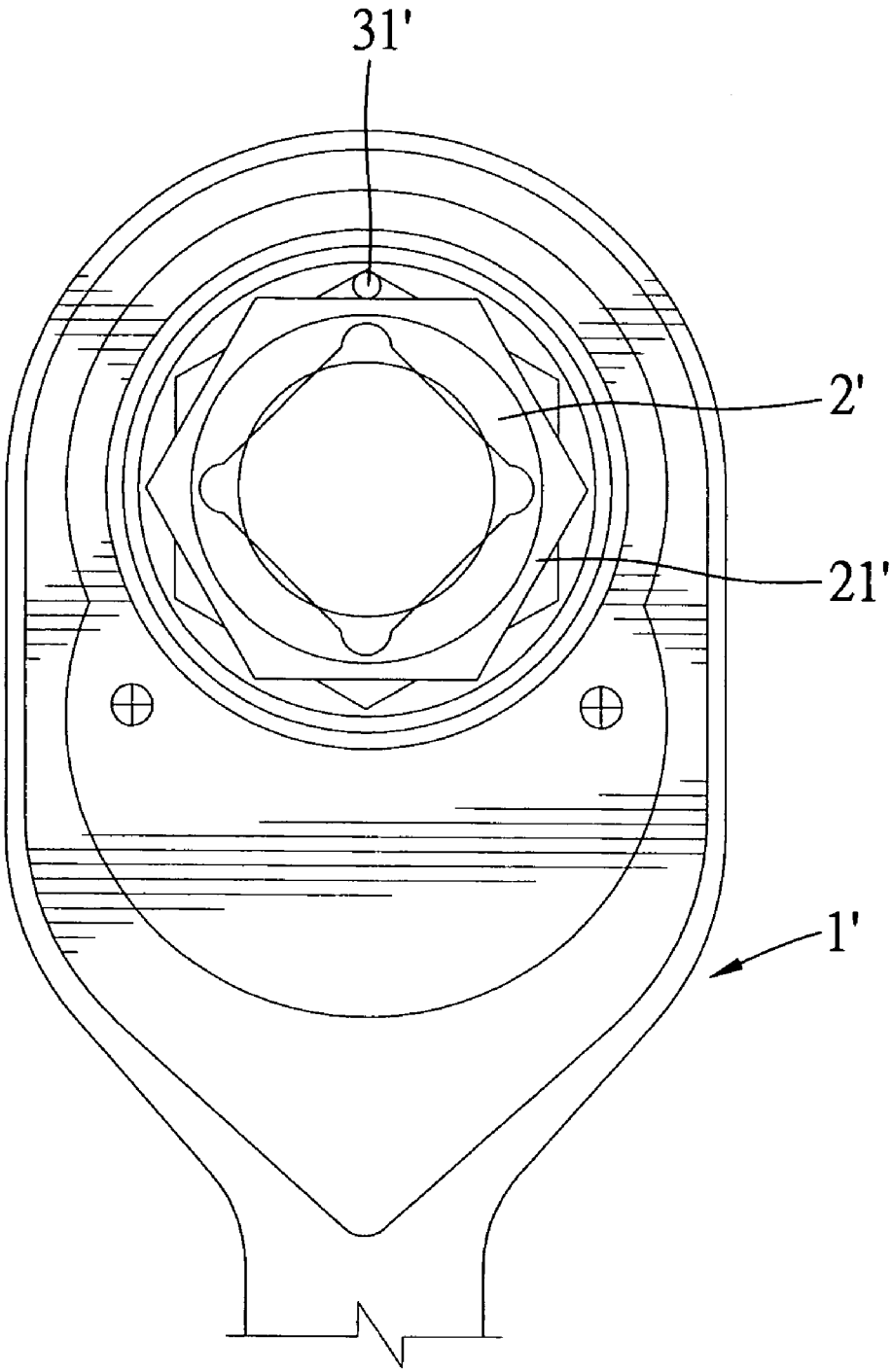
Fig. 7 PRIOR ART
FIG. 7 is a top view of the wrench combination in FIG. 6.
Figure 8:
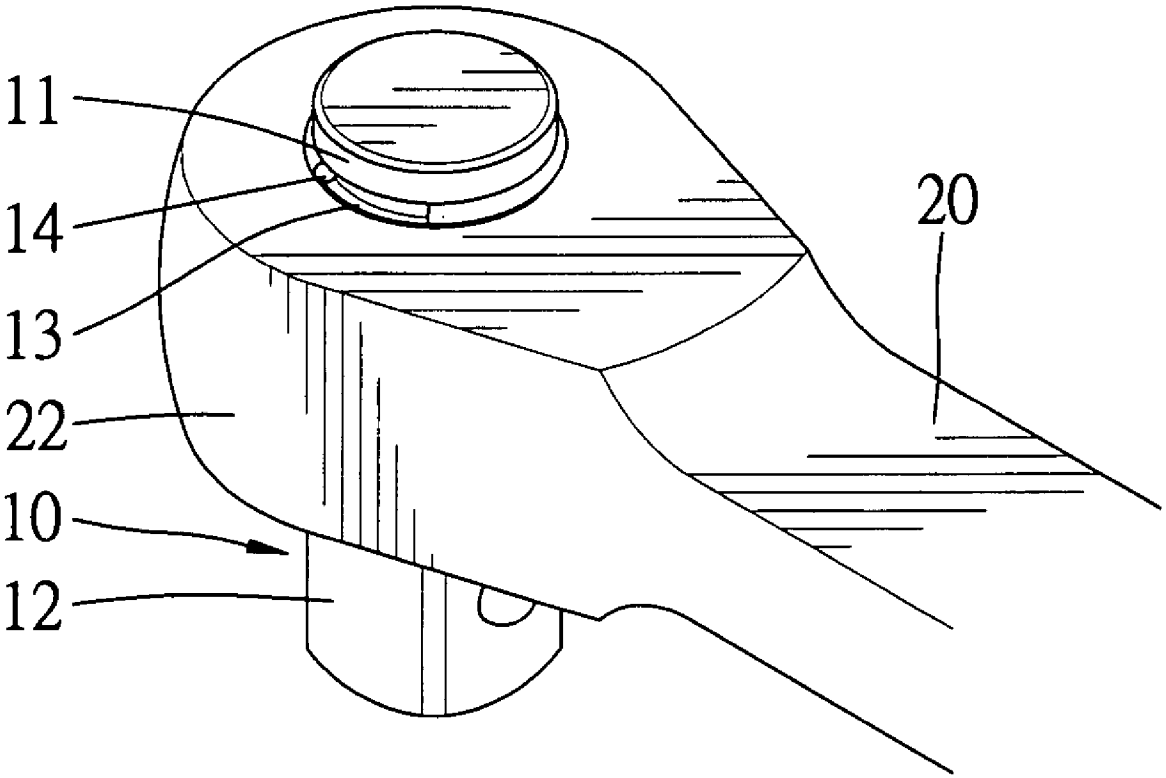
FIG. 8 is a partial perspective view of a first embodiment of a wrench combination in accordance with the present invention.
Figure 9:
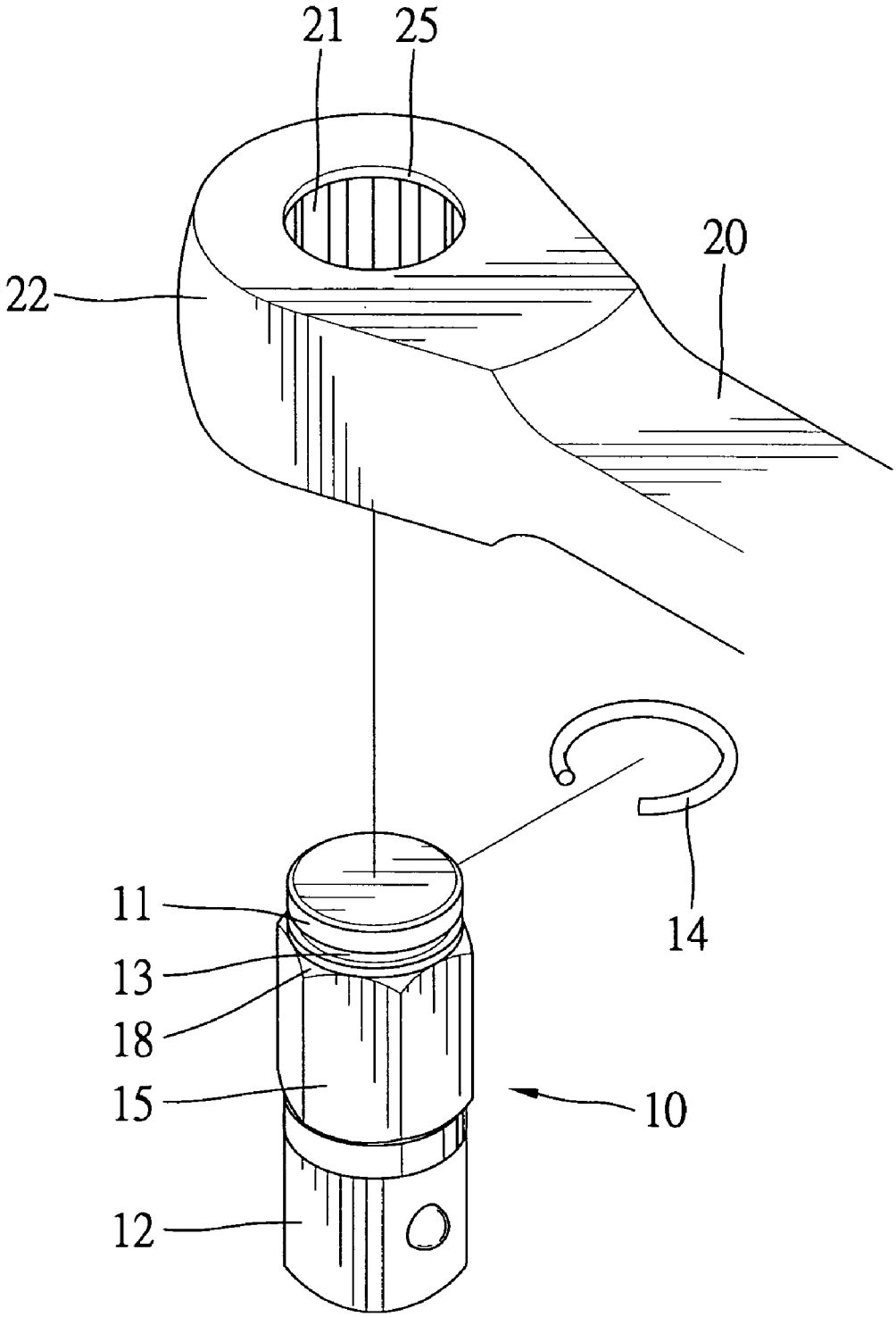
FIG. 9 is an exploded perspective view of the wrench combination in FIG. 8.
Figure 10:
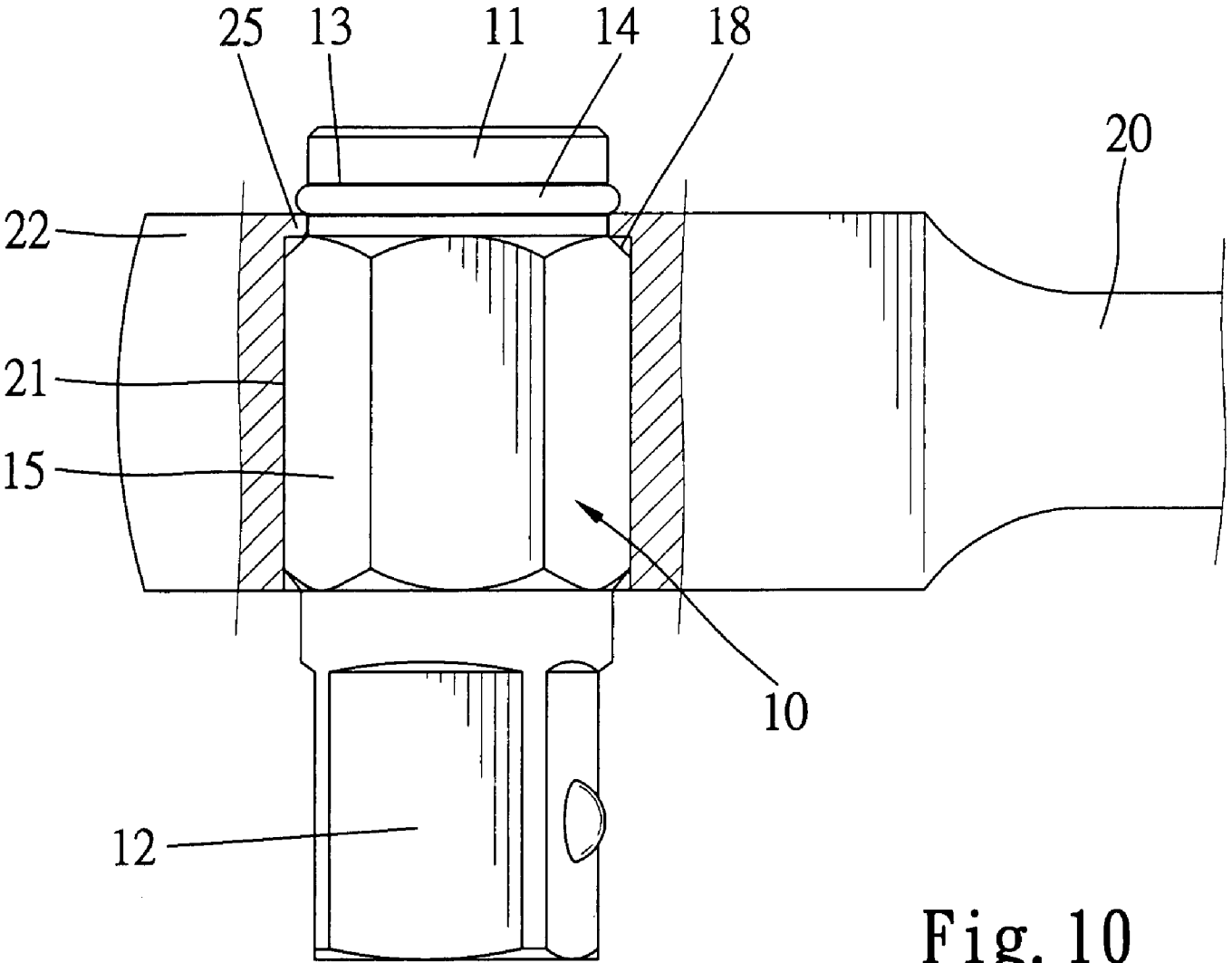
FIG. 10 is a partly sectioned side view of the wrench combination of FIG. 8 after assembly.

FIGS. 8 through 10 show a first embodiment of a wrench combination in accordance with the present invention. The wrench combination comprises a wrench 20 and a drive member 10. The wrench 20 includes a box end 22 having a polygonal inner periphery 21 for driving fasteners such as bolts.

The drive member 10 includes a first end 11 and a second end 12. The second end 12 of the drive member 10 is used to engage with sockets or to directly drive fasteners such as screws. In this embodiment, the second end 12 of the drive member 10 is used to engage with sockets (i.e., a socket-engaging member).

The first end 11 of the drive member 10 includes an annular groove 13. A resilient retaining member 14 (a C-clip in this embodiment) is mounted in the annular groove 13. The first drive member 10 further includes an engaging portion 15 between the first end 11 and the second end 12 of the drive member 10. The engaging portion 15 is preferably polygonal for engaging with the polygonal inner periphery 21 of the box end 22 of the wrench 20. An inner protrusion 25 extends from an end of the polygonal inner periphery 21. In this embodiment, the inner protrusion 25 is in the form of an annular flange extending along the polygonal inner periphery 21. Alternatively, the flange may be discontinuous. Further, the inner protrusion 25 may extend across only a section of the polygonal inner periphery 21.

The drive member 10 further includes a retaining section for retaining the drive member 10 in the box end 22 of the wrench 20. In this embodiment, the retaining section includes a shoulder 18 formed on the engaging portion 15 and facing the first end 11 of the drive member 10. The shoulder 18 has a diameter greater than a diameter of a hole delimited by the inner protrusion 25. The retaining member 14 in a natural (i.e., not deformed) state has an outer diameter slightly greater than the diameter of the hole delimited by the inner protrusion 25.

When mounting the drive member 10 into the box end 22 of the wrench 20, the first end 11 of the drive member 10 is inserted into the box end 22 of the wrench 20 via an end (the lower one) of the box end 22. The retaining member 14 is forcibly passed through the hole delimited by the inner protrusion 25 with a relatively large force. When the retaining member 14 passes through the inner protrusion 25, the retaining member 14 returns to its original uncompressed state and abuts against an outer side of the inner protrusion 25 while the shoulder 18 abuts against an inner side of the inner protrusion 25, preventing excessive insertion of the drive member 10.

The distance between the annular groove 13 and shoulder 18 (the retaining section) is equal to a thickness of the inner protrusion 25. Thus, the engaging portion 15 of the drive member 10 is securely retained in the box end 22 of the wrench 20. Disengagement of the drive member 10 from the box end 22 of the wrench 20 is avoided when removing a socket engaged with the second end 12 of the drive member 20. For removing the drive member 10 out of the box end 22 of the drive member 10, the user has to pull the second end 12 of the drive member 10 outward with a relatively large force sufficient to compress the retaining member 14 into the annular groove 13. Such a force is significantly larger than that required for disengaging a socket from the second end 12 of the drive member 10. Thus, undesired removal of the drive member 10 from the box end 22 of the wrench 20 during removal of a socket from the second end 12 of the drive member 10 is prevented.

Figure 11:
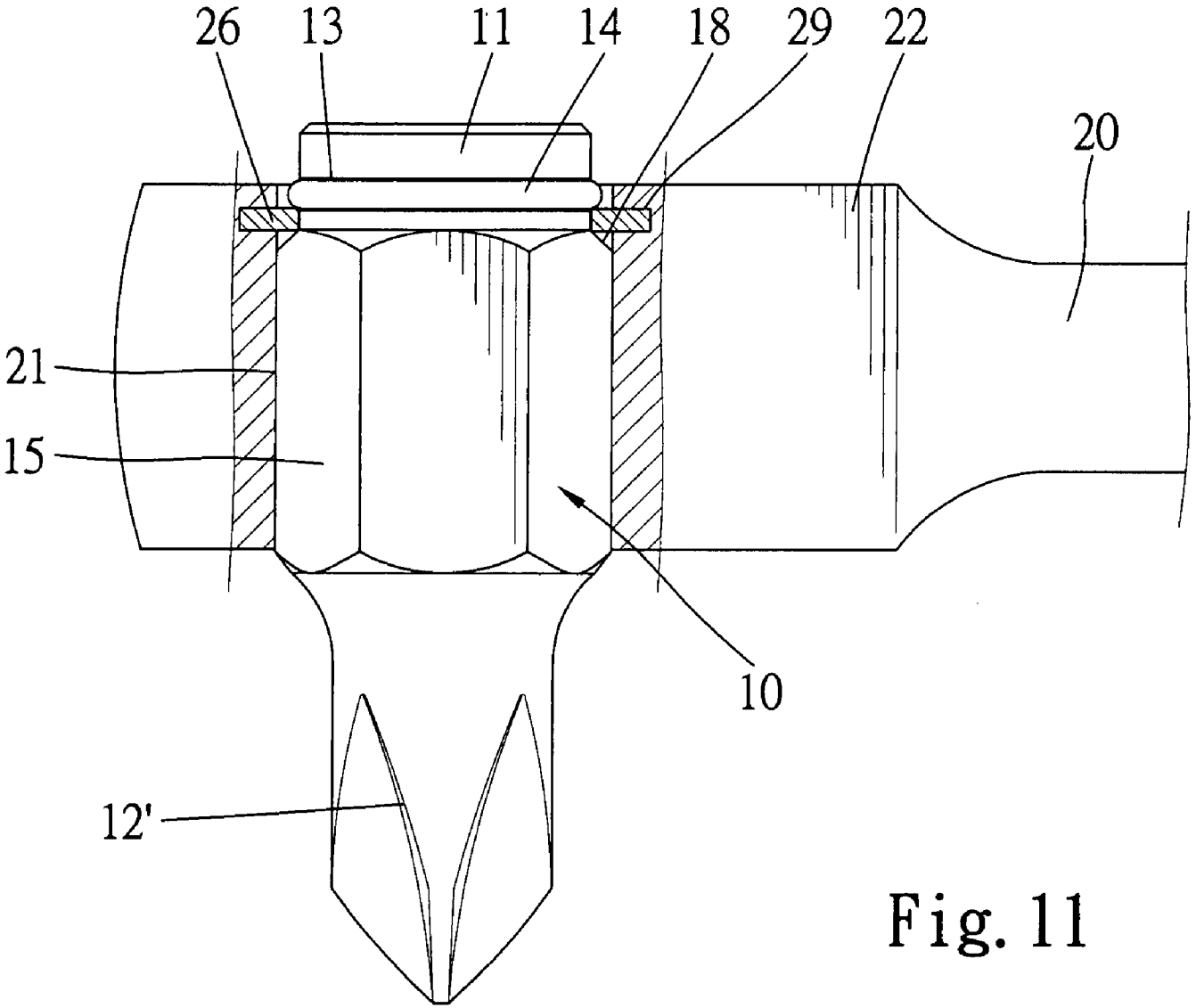
FIG. 11 is a partly sectioned side view of a second embodiment of the wrench combination in accordance with the present invention.

FIG. 11 illustrates a second embodiment modified from the third embodiment. In this embodiment, the second end of the drive member 10 is in the form of a screwdriver bit 12'. Further, the inner protrusion 25 in the third embodiment is omitted. Instead, an annular groove 29 is defined in the polygonal inner periphery 21 of the box end 22 of the wrench 20, and an insert 26 or the like is mounted in the annular groove 29 and protrudes into a hole delimited by the polygonal inner periphery 21 to form an inner protrusion. The insert 26 acts as the inner protrusion 25 in the first embodiment.

Figure 12:
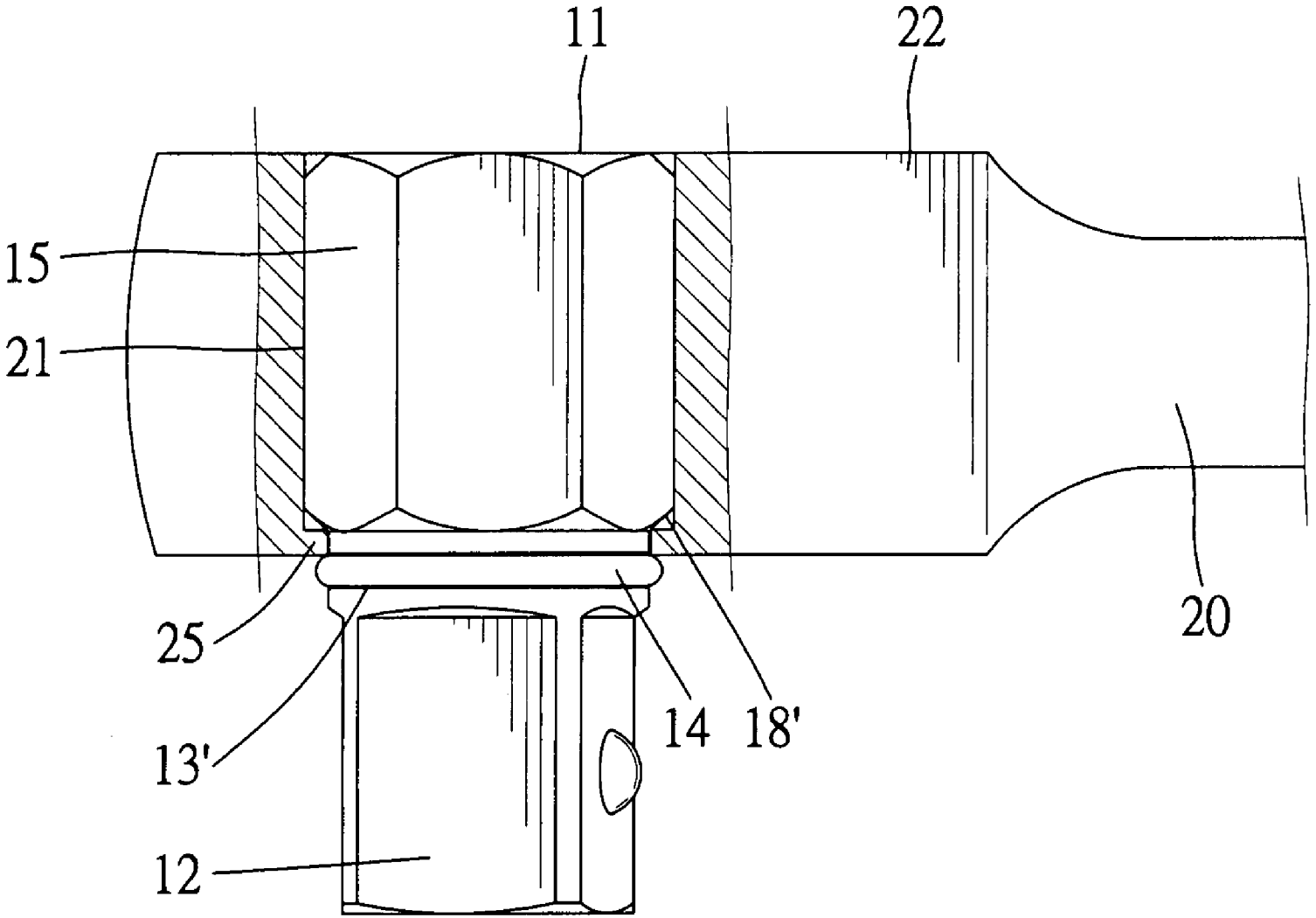
FIG. 12 is a partly sectioned side view of a third embodiment of the wrench combination in accordance with the present invention.

FIG. 12 illustrates a third embodiment modified from the first embodiment. In this embodiment, the wrench 20 includes a box end 22 having a polygonal inner periphery 21. An inner protrusion 25 is formed on an end (the lower one in FIG. 12) of the polygonal inner periphery 21. The drive member 10 includes a first end 11, a second end 12, and an engaging portion 15. The first end 11 becomes a part of the engaging portion 15. Of course, the first end 11 of the drive member 10 may extend beyond the box end 22 of the wrench 20 as the previous embodiments. The engaging portion 15 includes a shoulder 18' (i.e., a retaining section) facing the second end 12. Further, an annular groove 13' is defined between the engaging portion 15 and the second end 12 of the drive member 10. A retaining member 14 is mounted in the annular groove 13'. The retaining member 14 in a natural state has an outer diameter slightly greater than a diameter of a hole delimited by the inner protrusion 25. Use of the wrench combination of this embodiment is similar to that of the first embodiment.

Figure 13:
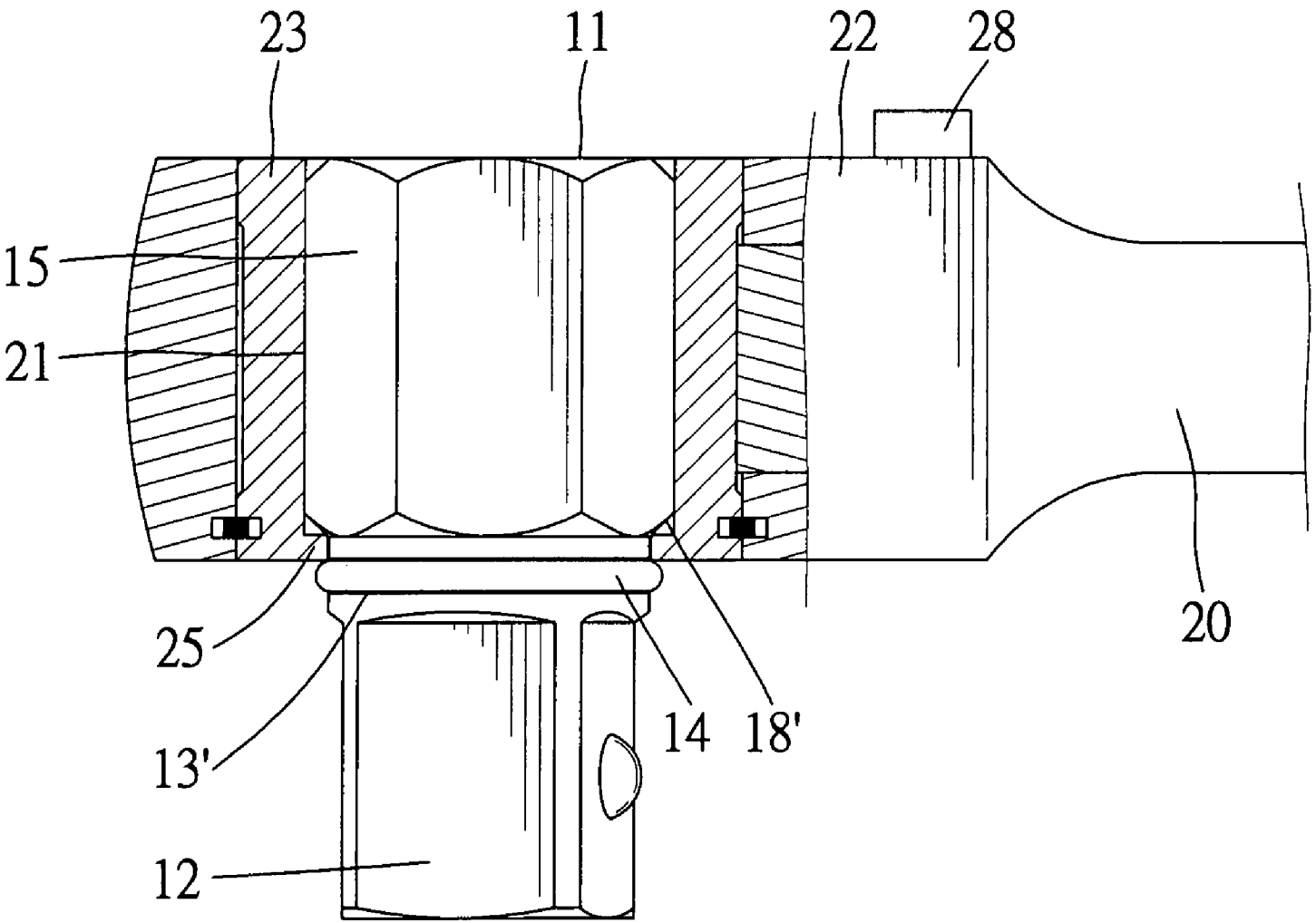
FIG. 13 is a partly sectioned side view of a fourth embodiment of the wrench combination in accordance with the present invention.

The wrench can be of the type including a gear and a switching member. As illustrated in FIG. 13, the wrench 20 includes a gear 23 mounted in the box end 22 of the wrench 20. The gear 23 includes a polygonal inner periphery 21 for driving fasteners. The wrench 20 further includes a switching member 28 that controls a ratcheting direction for driving a fastener and a free rotating direction. More specifically, a fastener is turned when the wrench 20 is turned in the ratcheting direction and the fastener is not turned when the wrench 20 is turned in the free rotating direction reverse to the ratcheting direction.

Although specific embodiments have been illustrated and described, numerous modifications and variations are still possible without departing from the essence of the invention. The scope of the invention is limited by the accompanying claims.

What is claimed is:

1. A wrench combination comprising:

a wrench including a box end, the box end of the wrench comprising a polygonal inner periphery, an inner protrusion being formed on the polygonal inner periphery;

a drive member comprising an engaging portion removably mounted in the box end of the wrench and engaged with the polygonal inner periphery, the drive member further including an end located outside the box end of the wrench, the engaging portion including a retaining section having an outer diameter greater than a diameter of a hole delimited by the inner protrusion, the retaining section abutting against an end face of the inner protrusion when the engaging portion is mounted in the box end of the wrench; and a retaining member mounted on the drive member and including an outer diameter greater than the diameter of the hole delimited by the inner protrusion, the retaining member abutting against another end face of the inner protrusion when the engaging portion is mounted in the box end of the wrench, the retaining member being compressible to be smaller than the diameter of the hole delimited by the inner protrusion.

2. The wrench combination as claimed in claim 1, with the retaining section being a shoulder.

3. The wrench combination as claimed in claim 1, with the inner protrusion being formed on an end of the polygonal inner periphery.

4. The wrench combination as claimed in claim 1, with the drive member including another end, with the engaging portion being located between said another end and the end of the drive member, said another end of the drive member including an annular groove, with the retaining member being received in the annular groove.

5. The wrench combination as claimed in claim 1, with the drive member including an annular groove defined between the engaging portion and the end of the drive member, with the retaining member being received in the annular groove.

6. The wrench combination as claimed in claim 1, with the polygonal inner periphery including an annular groove, with an insert being received in the annular groove and protruding into a hole delimited by the polygonal inner periphery to form the inner protrusion.

7. The wrench combination as claimed in claim 1, with the retaining member being a C-clip.

8. The wrench combination as claimed in claim 1, with the end of the drive member being a socket-engaging member.

9. The wrench combination as claimed in claim 1, with the end of the drive member being a screwdriver bit.

10. The wrench combination as claimed in claim 1, with the wrench including a gear rotatably mounted in the box end, and with the gear defining said polygonal inner periphery.

11. The wrench combination as claimed in claim 10, with the wrench further including a switching member for controlling a ratcheting direction and a free rotating direction of the gear.

12. The wrench combination as claimed in claim 4, with the retaining member being a C-clip.

13. The wrench combination as claimed in claim 5, with the retaining member being a C-clip.

14. The wrench combination as claimed in claim 1, with the retaining member abutting against said another end face of the inner protrusion when the retaining member is in a natural state.

15. The wrench combination as claimed in claim 1, with the inner protrusion being an annular flange.

* * * * *